US005871194A

United States Patent [19]

Morley

[11] Patent Number: 5,871,194

[45] Date of Patent: Feb. 16, 1999

[54] HINGED CLIP AND FITTED ARTICLE

[75] Inventor: Timothy Corben Morley, Birmingham, England

[73] Assignee: Aston Packaging Limited, Birmingham, United Kingdom

[21] Appl. No.: 765,833

[22] PCT Filed: Jul. 12, 1995

[86] PCT No.: PCT/GB95/01644

§ 371 Date: Jan. 10, 1997

§ 102(e) Date: Jan. 10, 1997

[87] PCT Pub. No.: WO96/02435

PCT Pub. Date: Feb. 1, 1996

[30] Foreign Application Priority Data

Jul. 13, 1994 [GB] United Kingdom ..... 9414170

[51] Int. Cl.[6] ..... A47B 95/00

[52] U.S. Cl. ..... 248/345.1; 24/489; 24/495; 24/547; 24/546; 108/27; 206/586; 206/592; 206/594; 428/122

[58] Field of Search ..... 248/345.1, 300, 248/228.7, 231.81; 108/27, 90; 312/140.4; 24/289, 297, 454, 457, 462, 489, 495, 546, 547; 206/586, 591, 592, 594; 49/462; 52/716.8; 428/122, 182, 184, 213

[56] References Cited

U.S. PATENT DOCUMENTS

| | | | |
|---|---|---|---|
| D. 360,053 | 7/1995 | Wilborn, II et al. | D28/38 |
| D. 367,223 | 2/1996 | Adams | D8/395 |
| 884,256 | 4/1908 | Addie | 24/546 X |
| 1,491,286 | 4/1924 | Calhoun | 24/457 X |
| 3,300,168 | 1/1967 | Gaudino | 248/231.81 X |
| 3,701,078 | 10/1972 | Lynch | 339/19 |
| 4,261,091 | 4/1981 | Mulkins | 248/345.1 X |
| 4,813,107 | 3/1989 | Cetrone | 24/489 X |
| 5,604,011 | 2/1997 | Morley | 428/122 |

*Primary Examiner*—Leslie A. Braun
*Assistant Examiner*—Gwendolyn Baxter
*Attorney, Agent, or Firm*—Steven J. Hultquist; William A. Barrett

[57] ABSTRACT

The invention teaches a hinged clip (10) comprising two arms (22), each arm having a free end (34) and an extension forming the other end, resilient bias means urging the free ends together, the extensions being movable towards one another against the force of the resilient bias means to separate the said free ends characterised in that the resilient bias means is non-removably secured to each arm. An edge protector for an article (14) having sides (16) joined by an edge (12) is also taught, as is the method of manufacture and use.

9 Claims, 2 Drawing Sheets

HINGED CLIP AND FITTED ARTICLE

FIELD OF THE INVENTION

This invention relates to a hinged clip and fitted article, and relates in particular to a hinged clip usable as an edge protector for an article having opposed generally-parallel sides joined by a peripheral edge (herein referred to as an article), and to an article fitted with such an edge protector hinged clip.

A typical article to which an edge protector can usefully be fitted is a door, worktop, or tabletop, having edges of uniform thickness. However the edge protector, being formed as a hinged clip, will fit an article periphery which is not of uniform thickness e.g. one or both of the article sides can be contoured, for decorative or other purposes, for instance a plaster moulding or a banister.

Furthermore, though the articles mentioned in the previous paragraph are generally planar, and so are stackable, there are many non-planar yet stackable articles for which an edge protector also has utility.

Though the peripheral edge is usually the outer peripheral edge e.g. the outer periphery of a chipboard panel covered with a veneer of plastics sheeting, for certain applications an edge protector can be fitted to an article inner peripheral edge.

Any part of an article edge can be damaged. "Continuous" or "near-continuous" edge protection is thus desirable both for an article with a rounded outer periphery, such as a round tabletop, and for an article having a rectangular outer periphery, and thus with corners, such as the above-mentioned door.

BACKGROUND TO THE INVENTION

Hinged clips are in widespread use, having arms with free ends resiliently biassed together and between which an article can be gripped, the other ends of the arms being squeezable towards one another so as to separate the free ends to permit release of the article. One use for a hinged clip is to self-secure to the edge of all article, to help protect the article edge from damage.

During or following manufacture, it is customary for several articles as referred to above to be laid horizontal and stacked one above another; alternatively they can be stacked on one edge, so as to be upstanding. The articles in the stack typically await removal to the next manufacturing stage or transfer into store ready for delivery to a customer.

During storage and transportation in particular, the peripheral edges of at least some articles of a stack can be damaged, reducing the value and perhaps utility of those damaged articles.

Even during subsequent delivery to a stockist or to the final customer, whether of a single article or of a stack of articles, article edges can be damaged.

It is desirable that the edge protector be of a material and design permitting a friction grip i.e. to the article opposed sides joined by the edge, so as to prevent inadvertent loss of the edge protector, as during single article transfer between locations, and so as to negate the need for separate attachments (which themselves may damage the article sides). Thus a hinged clip could provide a suitable edge protector.

If articles are manufactured in anticipation of later sales, then they are likely to be stacked in long-term storage. Using an edge protector having a (friction-grip) part which can be trapped between the sides of adjacent articles will however act to hold the article sides apart; if the friction-grip part is thick, fewer articles can be stacked in the height available, so that it is desirable that the edge protector be of "U-section" with at least the arms of the "U" formed from a single thickness material.

It will be understood that although a desired edge protector shape may readily nowadays be formed from a plastics material e.g moulded polystyrene or polyethylene, users are increasingly conscious of the environmental implications and the public reaction to long-term disposal problems, particularly for "one trip" packaging materials, and users have for some years been actively seeking environmentally acceptable alternatives. Further, in a technical area in which recycled or recyclable materials may easily be employed, many manufacturers and users are increasingly resisting the use of materials which are not and/or may not be recycled.

DISCLOSURE OF THE PRIOR ART

Hinged clips are known, comprising two arms and an intermediate (metal) torsion return spring, with each arm having an extension which can respectively be pressed together to separate the free ends of the arms against the spring force, the spring ends engaging the arms to return the clip towards its rest position. Hinged clips are also known which comprise two arms, but without arm extensions or an intermediate return spring, the clip being of U-shape and of a material selected so that the clip has a rest condition with the free ends of the arms touching, so that to separate the arms their free ends are levered apart.

Edge protectors are also known. Thus it is customary for stockists to require, and a manufacturer to fit, an article edge protector of a thickness designed to reduce the likelihood, and/or severity, of damage to exposed article edges.

A known recyclable material is corrugated paper, such as single-faced corrugated paper in which one corrugated sheet is adhered at the corrugation peaks to a sheet of substantially planar paper. The single-faced corrugated paper thus has on one side parallel exposed fluting running in a selected direction (transverse to the rolled direction of formed paper); such corrugated paper is flexible about mould lines parallel to the fluting and so has been found particularly useful for edge protectors for non-straight article edges.

Another form of corrugated paper, known as "board", has one corrugated sheet to either side of which is adhered a respective sheet of substantially planar paper.

One known edge protector utilises a hollow tube of impact absorbent material, cut to length and with a split along its length. In use, the tube is opened out at the split to form a "part-circular" edge protector; this may then be placed around the outer peripheral edge of the article, both frictionally to grip the article and to be ready to be positioned between the edges of similar articles of a stack. A first disadvantage of this edge protector is that the tube may inadvertently be split into two sections along its longitudinal length when its facing edges are being opened sufficiently to embrace an article edge, so that the edges of the (single) article are not concealed. The likelihood of such longitudinal split is increased if the article is stacked with others since the (part-circular) edge protector arms between adjacent articles will be squeezed flat, tending to burst open the longitudinal split. A second disadvantage of this edge protector as formed (of a single thickness material) is that the tube wall needs to be of significant thickness (in order to provide adequate edge protection), and this then means that the enforced (vertical) gap between stacked articles is greater than perhaps is desirable.

A known edge protector avoiding this first disadvantage is formed from single-thickness material, shaped using fold-lines into "U-section" lengths; however the arms of the "U" do not grip the opposed sides of the article and so may become detached from an article being transported to or from a stack. For stacked articles, the arms of the "U" provide edge protector parts which will lie between adjacent stacked articles, whilst the base of the "U" fits alongside, and so provides protection for, the article outer peripheral edge. But these edge protectors suffer the same second disadvantage as the "circular" edge protector above, requiring a thick base and so having thick (separator) arms; thus one such design of edge protector is pressed from a flat multi-layered paper, with therefore the arms of the "U" being of similar thickness to that of the base. The paper used is "semi-rigid", defined herein as foldable but adapted thereafter to substantially retain its folded shape, and being of paper avoids the disposal and environmental problems outlined above.

In a modified "U-section" arrangement, formed from a single piece of folded (semi-rigid) cardboard, adjacent to the base and extending between the opposed arms are added (three) further layers of semi-rigid cardboard, whereby to thicken the base as compared to the arms. This known design can meet two of the desirable criteria for an edge protector in that it is of recyclable material, and in that the arms of the "U-section" allow stacked articles to lie relatively closely together i.e. whilst the thickened base provides the required edge protection. However the further added layers tend to hold the arms of the "U" apart, to prevent the necessary friction grip needed to permit the edge protector to remain engaged around a single article being moved to or from a stack.

As an additional requirement, users require that the edge protector be made from a single length strip, mouldable at the workstation to fit around article curves or corners, and this has now become a fourth desirable criterion which an acceptable edge protector has to meet. If the edge protector is non-mouldable, then separate short lengths may be needed i.e for a curved periphery, and such short lengths are a nuisance to handle, particularly if a "length" already fitted can become detached whilst a subsequent "length" is being fitted. Also, if the article has corners these are likely still to be at risk from inadvertent damage, and desirably need a dedicated edge protector, since using adjacent lengths of "straight" or non-mouldable edge protectors has proved unsatisfactory, often leaving the corner exposed even if the lengths are "overlapped".

The above designs of edge protector, whether of recyclable material, whether with thinner arms (sidewalls) than the base, whether with a friction grip to a single article, have not been able to satisfy this (transverse) "mouldability" requirement. In particular they have substantially rigid arms which when worked to conform to a "non-straight" article edge do not bend progressively, but rather tend to break or buckle, often at irregular spacings along their length; the resulting substantial discontinuities cause raised arm portions, which then provide an uneven surface upon which, if in a stack, the next article must rest, unevenly, possibly inducing warping.

However, our own edge protector as disclosed in WO-94/04430 is of "U-section", the arms of the "U-section" being thinner than the base, the arms and a part of the base being formed from a single length of semi-rigid corrugated paper. The base includes extra layers of paper located between the arms. The fluting of the corrugations is selected to run laterally around the U-section, permitting longitudinal moulding.

One embodiment disclosed in WO-94/04430 is able to meet the above edge protector requirements, and so is able to provide significant edge protection both for single and for stacked articles. However, that edge protector is relatively difficult and costly to make and so is considered to be best suited to higher value articles. An alternative is therefore required. That edge protector has a base which may not locally deform clearly to show inadvertent impact positions where remedial action may be needed before the article is sold.

STATEMENT OF THE INVENTION

We seek to provide a hinged clip of novel construction. Thus according to one feature of our invention we provide a hinged clip which includes two arms, each arm having a free end and an extension forming the other end, and resilient bias means which urges the free ends together, the extensions being movable towards one another against the force of the resilient bias means to separate the said free ends characterised in that the resilient bias means is non-removably secured to each arm.

We also provide a hinged clip comprising two arms, each arm having an extension which can be pressed towards the extension of the other arm to separate the free end of one arm from the free end of the other, each extension being connected to a hinge. The hinge extensions provide a resilient bias acting to urge the arms in directions to return the clip towards its rest position. A hinge extension is integral with its arm, and with the other arm.

We also seek to provide an edge protector having the advantages of one embodiment of our earlier edge protector, providing substantially equivalent or only slightly less edge protection, and at a reduced manufacturing cost.

Thus according to another feature of our invention, we provide an edge protector of "U-section", having a base and opposed arms, and formed from semi-rigid paper, characterised by a hinge between the base and an arm. Preferably the base and the opposed arms are formed from a single piece of semi-rigid paper.

According to a further feature of our invention we provide an edge protector of "U-section" having a base and two upstanding arms characterised by a first hinge between the base and one of the arms and a second hinge between the base and the other of the arms, each hinge including a portion at an obtuse angle to the base.

Desirably the portion and the respective arm are connected at an acute angle, the portion and arm being connected to prevent relative hinging. Usefully the connection is by an adhesive.

According to an additional feature of the invention we provide an article having opposed article sides connected by an article edge, and an edge protector of "U-section" comprising a base and opposed arms having a first position relative thereto, the base and opposed arms being connected by first and second hinges, the opposed arms being hinged when fitted to the article to a second position whereby frictionally to grip the article opposed sides between the arms. The base faces the article edge and may be in contact therewith. The free ends or extremities of the arms i.e. the portions furthest from the base, before fitting to the article are spaced apart less than the thickness of the article edge. In one arrangement the arms before being fitted (the free state of the edge protector) are touching, with slight internal stressing; but in an alternative embodiment the free ends of the arms are separated even in the clip rest condition, and so for fitting to an article edge are forced further apart, usefully by manual pressure to the hinged extensions.

According to yet a further feature of the invention we provide a method of assembling an edge protector having upstanding arms with respective free ends to the sides of an article joined by an article edge which includes separating the free ends, feeding the free ends parallel or substantially so across the article sides, and releasing the arms so that they can engage the sides whereby frictionally to grip the article.

Usefully the free ends are (outwardly) separated by inwards pressure adjacent the base, applied by hand or machine. The base and each respective arm will be connected by a folded sheet portion, forming a grippable elbow located to the side of the base remote from the free end of the arm.

According to yet another feature of the invention we provide a method of manufacturing an edge protector which includes the steps of forming a first pair of spaced longitudinal fold-lines to one face of a semi-rigid paper sheet and to opposite sides of a central longitudinal axis, forming a second pair of spaced fold-lines to the other side of the sheet, the second pair being to opposite sides of said longitudinal axis and being spaced apart by a different distance than the first pair, deforming the sheet about said fold lines to provide a pair of upstands joined across said longitudinal axis into a "U" section, applying adhesive to a respective part of the sheet outwardly of the upstands, folding undeformed sheet parallel to the upstands, and holding the respective part of the folded sheet against the upstands until the adhesive has set. Preferably the adhesive is applied as a pair of continuous longitudinally extending strips, but could be dispensed as individual droplets along the longitudinal line.

SHORT DESCRIPTION OF THE DRAWINGS

The invention will be further described, by way of example, with reference to the accompanying drawings, in which.

DESCRIPTION OF THE EXEMPLARY EMBODIMENTS

In this description, similar parts of the different embodiments carry the same numbers.

Figure 1:
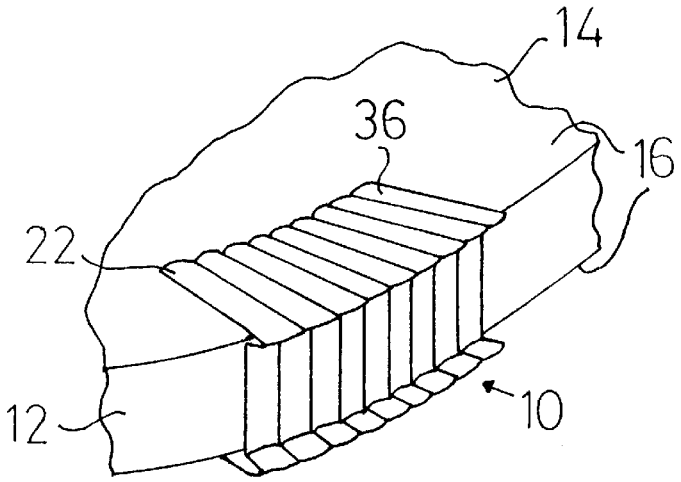
FIG. 1 is a perspective view of a hinged clip according to the invention adapted for use as an edge protector and fitted to a part of a non-straight article edge.

In FIG. 1, an hinged clip or edge protector 10 is fitted about part of an edge 12 of an article 14, in this embodiment the outer peripheral edge of a curved article such as a table top. Although for clarity only a short-length edge protector is shown, protecting only a part of the periphery, in normal practice all the article outer periphery would typically be protected, either by a number of similar short lengths placed end-to-end along the periphery, or preferably by a single unitary length longitudinally moulded around the article edge.

An edge protector so fitted will help prevent inadvertent impacts and the like from damaging the article edge, and so possibly reducing the utility and/or value of the article. Typically, scuffs, scratches and like damage to the article edge can be prevented or much reduced.

As will be more fully described below, the edge protector is of a structure to grip the opposed sides 16 of the article so as not to become detached therefrom, as might otherwise occur during lifting or other movement of the article. Thus no separate means (cord or tape) are provided to hold the edge protector in the position illustrated in FIG. 1. The edge protector can usefully remain in position even after final article sale, being removed only by the eventual customer at the intended place of use.

As viewed in FIG. 1, the article 14 is lying flat, prior to being stacked with similar articles, perhaps for storage or awaiting transport to another workstation. When so stacked at least one of the arms 22 of the edge protector is positioned between the sides of adjacent articles, holding the articles apart; for an article in mid-stack, both arms 22 are so positioned.

Figure 2:
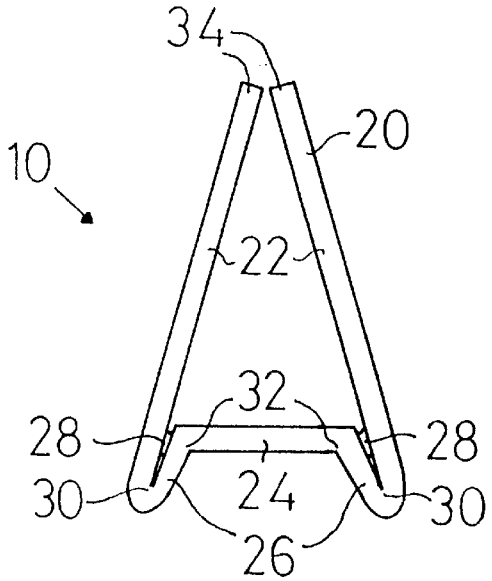
FIG. 2 is an end view of the edge protector of FIG. 1, formed as a hinged clip, prior to fitment onto an article.
Figure 4:
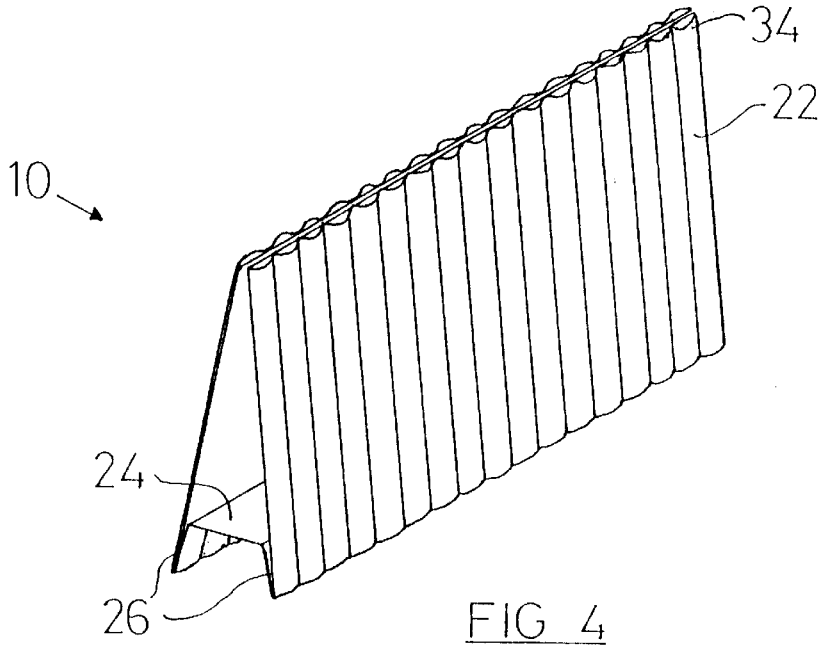
FIG. 4 is a perspective view of another edge protector according to the invention, prior to fitment onto an article.
Figure 5:
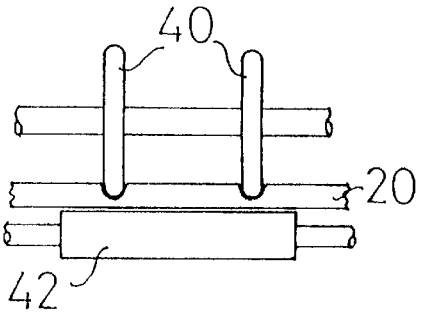
FIG. 5 is a schematic end view of a first creasing station, having an apparatus for forming a first pair of fold-lines.
Figure 6:
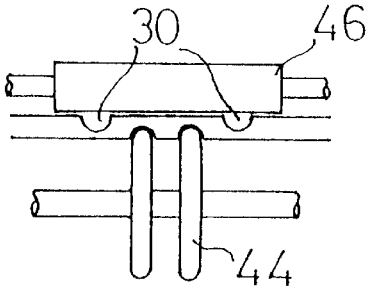
FIG. 6 is a schematic end view of a second creasing station, having an apparatus for forming a second pair of fold-lines.
Figure 7:
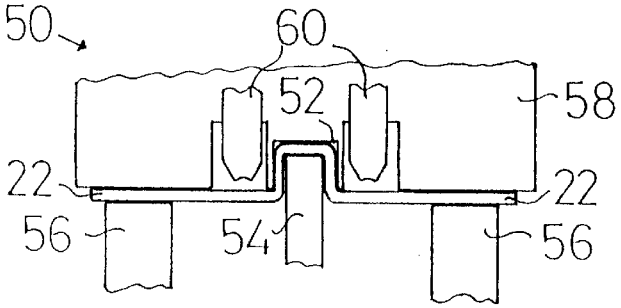
FIG. 7 is a schematic end view of a first folding station.
Figure 8:
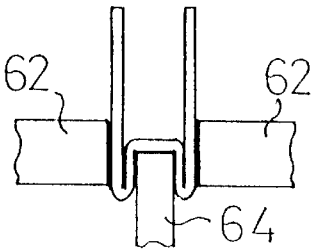
FIG. 8 is a schematic end view of a second folding station and a forming station.

The edge protector 10 is of single-faced corrugated paper, and comprises a unitary sheet 20 (FIG. 2), bent generally into a "U-section" and, as best seen in the embodiment of FIG. 4, with the exposed flutes facing outwardly.

According to this embodiment of the invention, the edge protector has two arms 22, a base 24, and two projecting elbows 26. The arms 22 have d free end 34, and the base 24 is nearer the free ends than are the elbows.

The elbows 26 comprise a double layer of the sheet 20, folded upon itself, the layers being adhered together by glue 28. The connection to the base 24 is by an obtuse angle (in the free or unstressed condition of FIG. 2), whilst the double layer includes an acute angle.

Thus, the sheet 20 has a first pair of fold-lines 30, and a second pair of fold-lines 32. The sheet is folded by approximately 180° at the first fold-lines 30, and by less than approximately 90° at second fold-lines 32. The tendency of the material is to straighten out the folds; however, the folds about the first fold-lines 30 are held by the glue 28, but the folds about the second fold-lines 32 are not held together and act so as to move the elbows 26 apart whereby to bring the free ends 34 of the arms together.

In use and to embrace a selected article edge 12, all edge protector 10 will be selected from those having a base 24 equal to or preferably slightly greater in cross-sectional dimension than the thickness of the edge (i.e. the spacing between opposed article sides 16), and having a separation between the free ends 34 less than the thickness of the article edge; when the correct edge protector has been selected a length thereof is used corresponding to the peripheral length of the article edge, though alternatively a number of shorter lengths end-to-end can be substituted. It will be understood that it is not necessary to have an edge protector with a base equal in cross-sectional dimension to the thickness of the article edge, since the friction grip provided by the arms allows for relatively large tolerances in article edge dimensions for a particular edge protector; thus, one size of edge protector can fit several articles having different edge dimensions.

Figure 3:
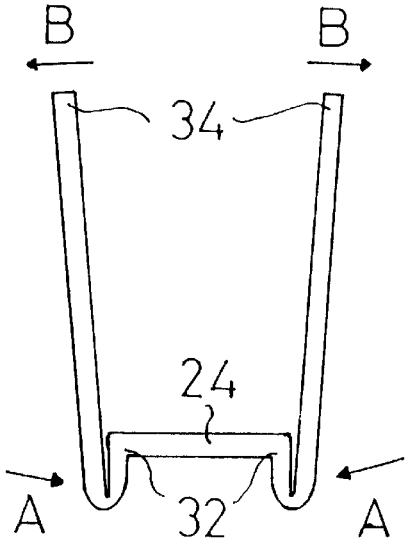
FIG. 3 is a view as in FIG. 2, with the arms of the edge protector hinged outwardly.

For fitment of the edge protector 10 to the article edge 12, the elbows 26 are be squeezed together, as by finger pressure in the direction A (FIG. 3), which will act to hinge the arms 22 and separate the free ends 34 in direction B (the arms pivoting about second fold-lines 32); when so separated, the free ends can be moved parallel to the article sides 16, either in sliding contact with these respective sides or more usually spaced therefrom, until the edge protector is positioned around the article edge.

Once in position (as in FIG. 1), the elbows 26 are released, whereupon the edge protector will attempt to return to tie FIG. 2 condition, causing the arms 22 to "frictionally grip" the article sides 16 so as to prevent the edge protector from inadvertently detaching from the article edge e.g. when the article is lifted from the stack and transported.

It will be understood that the pressure in direction A to separate the free ends 34 prior to fitment of the edge protector to an article edge can be provided automatically, as by a machine mounted adjacent the article; thus we envisage that our edge protector may be fitted to an article as part of an automated manufacturing sequence.

In this embodiment, the flutes 36 of the corrugated paper face to the outside of the U-section; this has the advantage that facing flat faces provide a large contact area for glue 28, and the advantage that in use a flat face of the corrugated paper can lie alongside each adjacent face of the article, to reduce the risk of damage to the article, for example from scratches by debris resting between the flutes 36. However, in an alternative embodiment the flutes face inwardly of the U-section, and in yet another alternative embodiment the edge protector is manufactured from corrugated board. In both of these alternative embodiments the flutes of one edge protector cannot enmesh with the flutes of an adjacent edge protector, as may occur when two or more articles, each having a fitted edge protector, are stacked together, and which enmeshing may cause difficulty in sliding one article relative to another.

The elbows 26 are formed from re-entrant portions of the sheet material and so as above indicated comprise two layers of corrugated paper held together in the preferred embodiment by a longitudinal strip of glue. As such they provide the first stage impact protection (except from sharp objects narrower than the spacing between elbows 26); the base 24 is of single-thickness material and provides the second stage impact protection. Thus the edge protector can give the degree of edge protection typically required, for instance against accidental low-speed impacts; deformation of an elbow can indicate the locality of possible impact damage to the article edge, permitting corrective action.

The elbows 26 also provide the hinged extensions to arms 22, with inbuilt resilient bias of the free ends 34 of the arms together, one towards the other. The respective spring so provided is at one end of each arm, not at an intermediate part, and is integral with the arm(s) i.e. not another component assembled therewith.

FIGS. 5–8 show one sequence of operations for the manufacture of a continuous length of edge protector according to the invention.

To provide such continuous length of edge protector, it is preferred that the sheet 20 move past the (fixed) creasing, folding and forming stations, though in a less preferred arrangement the stations can move along the paper length, perhaps forming one length on the outwards pass and another on the inwards or return pass.

In the embodiment shown, the moving sheet 20 arrives from a roll (not shown, but above the page as viewed) in known fashion, already cut to the width required i.e. the dimension of each of {a} the arms 22, {b} the base 24 and {c} the elbows 26 is predetermined.

A first pair of rotating wheels 40 make surface depressions to provide a first pair of fold-lines 30; in an alternative embodiment the sheet surface can be cut by rotating blades. A roller 42 holds the sheet 20 against the wheels so as to ensure the correct width and depth of depression in the sheet 20, in order that the sheet will fold as described below.

A second pair of rotating wheels 44 make the second pair of fold-lines 32; again a roller 46 holds the sheet 20 against the wheels to ensure the correct size depression is made in the sheet 20.

The sheet 20 then enters a first folding station 50 (FIG. 7), where the central section of sheet 20 (which will form the base 24, and portions of each respective elbow 26) is forced into a channel 52 by roller 54. Simultaneously, rollers 56 ensure that the (outer) sections of the sheet which will form the arms 22 are held flat. It will be understood that it may be necessary to maintain this formed shape for several seconds, so that there will preferably be a series of spaced rollers successively engaging the sheet; alternatively, the intermittently spaced rollers can be replaced by fixed beams supporting moving belts, the belts travelling at the same speed as the moving sheet 20, to provide substantially continuous support.

In the embodiment shown the channel 52 is provided in a base plate 58, and is fixed. However, the channel can alternatively also be provided by moving belts, travelling at the same speed as the moving sheet 20.

At or adjacent the folding station 50 there are a pair of glue applicators 60, which each dispense a continuous strip of glue onto the moving sheet 20.

Following application of the glue, the arms 22 of the sheet are folded upwardly (as viewed) about first fold-lines 30, at a second station (which preferably is connected to the folding station 50 as part of a single folding machine), and a pair of forming rollers 62 (or alternatively forming beams supporting moving belts), press the legs against the roller 64 (or alternatively beam supporting moving belts) and so hold it whilst and until the glue sets; once the glue has set, the sheet is shaped as an edge protector to the free or unstressed edge protector shape.

The process described above can provide a continuous length of edge protector equal to the length of sheet on the supply roll. This continuous length of edge protector can be cut to length as desired, either by the manufacturer or user. It may be possible to coil lengths of the finished article before despatch to users, with the coil wound corresponding to the coiled direction of use about a curved article such as that shown in FIG. 1.

In a less preferred embodiment, the edge protector could instead be manufactured from three separate pieces of corrugated paper i.e. {a} an upturned U-section piece providing the base and portions of the elbows, with {b} two (substantially flat) pieces providing the arms and the remainder of the elbows adhered thereto.

We have thus disclosed an edge protector which is simple and relatively inexpensive to manufacture, which may be manufactured to any desired length, and to a multitude of base, arm and elbow dimensions, to suit the article edge to which the protector is desired to fit. The protector can clip positively and relatively tightly to the article, reducing the likelihood of inadvertent loss or removal of the protector. A protector of given dimensions is capable of accommodating large tolerances in the dimension of article edge to which it is fitted, whilst still maintaining effective edge protection. In addition, the edge protector may be readily and quickly fitted to the article, either by manual or mechanical means. The elbow, comprising a double thickness of the sheet from which the protector is formed, and a strip or layer of glue, provides a first stage impact protection. Our edge protector can easily be longitudinally moulded around corners or bends of an article edge, and it minimises the space between adjacent articles when stacked.

An edge protector as herein disclosed can be used for personal protection, before and/or following installation, for instance around the edges of a glazing sheet, or upon metal shelving having an exposed corner at eye height.

We have further disclosed a hinged clip of simple, integral construction, with a minimum number of separate components.

I claim:

1. An edge protector which includes two arms, each arm having a free end and an extension forming the other end, a base member, having a first side and a second side, located between the arms, the arms each (i) extending away from the first side of the base member to said free end thereof, and (ii) extending away from the second side of the base member to said extension forming the other end thereof, and resilient bias means which urges free ends together, the extensions being moveable toward one another against the force of the resilient bias means to separate said free ends, the resilient bias means being non-removeably secured to each arm, with each extension being connected to a re-entrant portion, and the re-entrant portion being joined to the base member by a hinge, wherein each extension is joined to the re-entrant portion by an elbow, whereby the arms can grip and protect the sides of an article while elbows are spaced from an article edge and are adapted to accept blows directed at the article edge.

2. The edge protector according to claim 1, in which the base member and the opposed arms are formed from a single length of semi-rigid paper.

3. The edge protector according to claim 2, wherein each elbow is formed by a fold in the paper.

4. The edge protector according to claim 1, wherein a first hinge is provided between the base member and one of the arms and a second hinge is provided between the base member and the other of the arms, each hinge including a portion at an obtuse angle to the base member, wherein the portion and the respective arm are connected at an acute angle, the portion and arm being connected to prevent relative hinging, and wherein the connection is by an adhesive.

5. The edge protector according to claim 1, wherein the arms have a first relative position, the arms being hinged when fitted to an article, the article having opposed article sides connected by an article edge, and the edge protector having a second relative position frictionally gripping the article opposed sides between the arms, and the base member facing the article edge.

6. The edge protector according to claim 1, wherein the base and each of said arms is formed from corrugated paper.

7. The edge protector according to claim 6, wherein corrugations of the paper are outwardly facing.

8. The edge protector according to claim 6, wherein the base member, re-entrant portions, and arms are formed from a single length of paper, and wherein corrugations of the paper run from the free end of one of the arms to the free end of the other arm.

9. A method of assembling an edge protector to an article having opposed article sides joined by an article edge, comprising the steps of providing an edge protector which includes two arms, each arm having a free end and an extension forming the other end, a base member, having a first side and a second side, located between the arms, the arms each (i) extending away from the first side of the base member to said free end thereof, and (ii) extending away from the second side of the base member to said extension forming the other end thereof, and resilient bias means which urges the free ends together, the extensions being moveable toward one another against the force of the resilient bias means to separate said free ends, the resilient bias means being non-removeably secured to each arm, with each extension being connected to a re-entrant portion, and the re-entrant portion being joined to the base member by a hinge, and wherein each extension is joined to the re-entrant portion by an elbow, whereby the arms can grip and protect the sides of an article while the elbows are spaced from the article edge and are adapted to accept blows directed at the article edge, separating the arm free ends, feeding the free ends parallel or substantially so across the article sides, and releasing the arms so that they can engage the sides frictionally gripping the article.

* * * * *

UNITED STATES PATENT AND TRADEMARK OFFICE

CERTIFICATE OF CORRECTION

PATENT NO : 5,871,194

DATED : February 16, 1999

INVENTOR(S) : Timothy C. Morley

It is certified that error appears in the above-identified patent and that said Letters Patent is hereby corrected as shown below:

Column 6, Line 32, change "d" to --a--
Column 6, Line 49, change "all" to --an--
Column 7, Line 9, change "tie" to --the--

Signed and Sealed this

Thirty-first Day of August, 1999

*Attest:*

Q. TODD DICKINSON

*Attesting Officer*

*Acting Commissioner of Patents and Trademarks*